US005632425A

United States Patent [19]

Hull

[11] Patent Number: 5,632,425

[45] Date of Patent: May 27, 1997

[54] INFANT CARRIER

[76] Inventor: Julie Hull, 12480 S. Riverton Dr., Riverton, Utah 84065

[21] Appl. No.: 503,309

[22] Filed: Jul. 17, 1995

[51] Int. Cl.[6] ..... A61G 1/00

[52] U.S. Cl. ..... 224/160; 224/158; 224/159; 224/600; 224/605; 224/257; 224/759; 224/255; 2/111

[58] Field of Search ..... 224/153, 158, 224/159, 160, 161, 195, 197, 202, 206, 209, 213, 215, 216, 224, 257, 259, 208, 253, 255; 2/94, 104, 111

[56] References Cited

U.S. PATENT DOCUMENTS

| | | | |
|---|---|---|---|
| D. 322,695 | 12/1991 | Ladue | D30/144 |
| 2,599,474 | 6/1952 | Mills | 224/6 |
| 3,780,919 | 12/1973 | Hansson | 224/160 |
| 3,871,562 | 3/1975 | Grenier | 224/6 |
| 4,139,131 | 2/1979 | Hathaway | 224/160 |
| 4,149,687 | 4/1979 | Nunemacher | 224/159 |
| 4,234,229 | 11/1980 | Arnold | 297/467 |
| 4,428,514 | 1/1984 | Elf | 224/151 |
| 4,492,326 | 1/1985 | Storm | 224/160 |
| 4,941,604 | 7/1990 | Nagareda | 224/160 |
| 4,986,458 | 1/1991 | Linday | 224/160 |
| 5,190,306 | 3/1993 | Nauman et al. | 280/202 |
| 5,246,152 | 9/1993 | Dotseth | 224/159 |

FOREIGN PATENT DOCUMENTS 1332928 11/1994 Canada .

*Primary Examiner*—David J. Walczak
*Assistant Examiner*—Timothy L. Maust
*Attorney, Agent, or Firm*—Thorpe, North & Western

[57] ABSTRACT

A wearable infant carrier. The carrier is a type of durable shirt having a front portion and a back portion which is removably attachable to the front portion. The carrier can be slipped on over the wearer's head so that the front portion is draped across the wearer's torso and the back portion extends from the wearer's shoulders along the back and around opposing sides of the wearer for attachment to the front portion to form a sitting support with the front portion. After the carrier is secured upon the wearer, an infant can be placed between the front portion of the carrier and the wearer's torso so that the infant sits in suspension upon the sitting support with the infant's legs straddling the sitting support. The carrier thereby holds the infant sandwiched between the front portion of the carrier and the wearer.

23 Claims, 1 Drawing Sheet

INFANT CARRIER

BACKGROUND OF THE INVENTION

1. The Field of the Invention

The present invention relates generally to wearable infant carriers. More particularly, it concerns a wearable infant carrier having fewer parts and being made from a single strip of material.

2. The Background Art

A number of different infant carriers have been designed for convenient carrying of infants. Wearable infant carriers are popular in the form of back pack devices and, more recently, carriers designed to hold the infant in front of the wearer.

The prior art is thus replete with many different designs for wearable infant carriers, including those disclosed in U.S. Pat. Nos. 5,246,152 (issued Sep. 21, 1993 to Dotseth), 4,941,604 (issued Jul. 17, 1990), 4,428,514 (issued Jan. 31, 1984), 4,234,229 (issued Nov. 18, 1980), 3,871,562 (issued Mar. 18, 1975 to Grenier) and 2,599,474 (issued Jun. 3, 1952 to Mills). Unfortunately, the wearable infant carriers known in the prior art are characterized by a number of distinct disadvantages, including an abundance of buckles and attachment structure and numerous sewn parts. The manufacture of such carriers is thus quite expensive and labor intensive, and it is time consuming for the wearers to put on and remove the carriers.

OBJECTS AND SUMMARY OF THE INVENTION

It is therefore an object of the present invention to provide a wearable infant carrier which is simpler in design and manufacture.

It is another object of the invention to provide such a wearable infant carrier which is easier to use.

It is an additional object of the invention, in accordance with one aspect thereof, to provide such a wearable infant carrier which is made from a single strip of continuous material.

The above objects and others not specifically recited are realized in a specific illustrative embodiment of a wearable infant carrier. The carrier is a type of durable shirt having a front portion and a back portion which is removably attachable to the front portion. The carrier can be slipped on over the wearer's head so that the front portion is draped across the wearer's torso and the back portion extends from the wearer's shoulders along the back and around opposing sides of the wearer for attachment to the front portion to form a sitting support with the front portion. After the carrier is secured upon the wearer, an infant can be placed between the front portion of the carrier and the wearer's torso so that the infant sits in suspension upon the sitting support with the infant's legs straddling the sitting support. The carrier thereby holds the infant sandwiched between the front portion of the carrier and the wearer.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
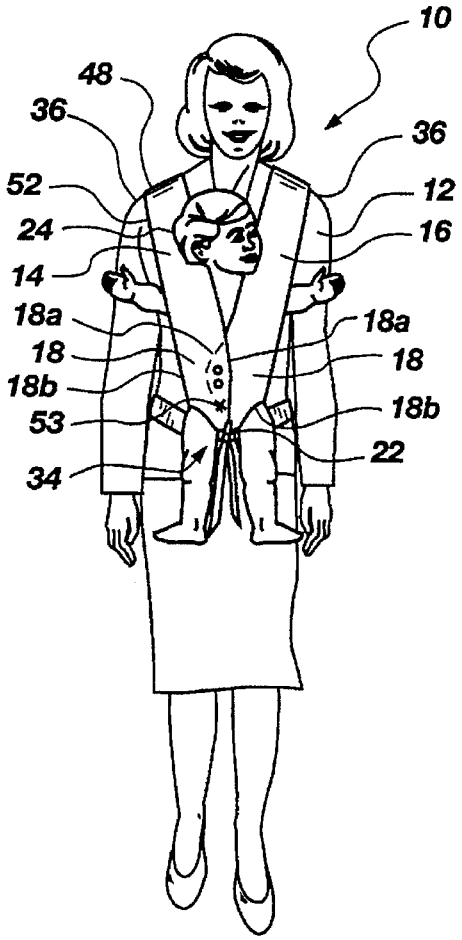
FIG. 1 is a frontal view of a wearable infant carrier made in accordance with the principles of the present invention being worn by an adult with an infant in place.

For the purposes of promoting an understanding of the principles in accordance with the invention, reference will now be made to the embodiment illustrated in the drawings and specific language will be used to describe the same. It will nevertheless be understood that no limitation of the scope of the invention is thereby intended. Any alterations and further modifications of the illustrated device, and any additional applications of the principles of the invention as illustrated herein, which would normally occur to one skilled in the relevant art and possessed of this disclosure, are to be considered within the scope of the invention claimed.

Figure 2:
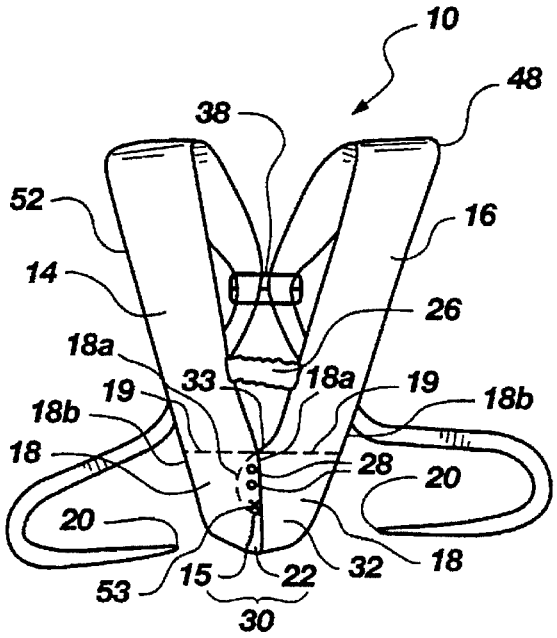
FIG. 2 is a more detailed frontal view of the wearable infant carrier of FIG. 1.

Referring now to FIGS. 1–2, there is shown a carrier, designated generally at 10, to be worn by an adult 12 as in FIG. 1. The carrier 10 preferably comprises a single strip of cloth which is folded in half at mid-portion 15 so as to include first and second retaining straps 14 and 16, which may also be described as right and left retaining straps, respectively. Each strap 14 and 16 includes a carrier end section 18 and an opposing attachment end section 20. The cloth strip 12 varies in thickness as shown, and is preferably gathered and configured at the mid-portion 15 with a soft-cloth tying ring 22 attached at the mid-portion.

As shown in FIG. 1, the carrier 10 is worn as a kind of tank-top harness by simply placing the carrier 10 over the wearer's head so that the tying ring 22 is positioned at about waist level or higher, depending on the size of the baby. The retaining straps 14 and 16 thereby extend upward and over the left and right shoulders, respectively, and further extend down the back so that the ends 20 wrap around opposing sides of the waist and are tied in front at the tying ring 22. Preferably, the ends 20 are inserted through opposing sides of the tying ring 22 after which they are tied to the ring in a secure square knot. The left and right retaining straps 14 and 16 are configured and dimensioned to be wide enough to retain an infant 24 at the wearer's front torso.

A suitable holding means such as a headband 26 is secured at its opposing ends to the straps so as to intercouple the straps. The headband 26 is preferably an elastic member to accommodate different head sizes with respect to the infant 24. The headband 26 can be used to extend across the forehead of the infant 24, such as while the infant is sleeping, for inhibiting movement of the infant's head relative to the straps 14 and 16 to prevent it from flopping downwardly. The headband 26 is especially useful when the infant 24 is sleeping and the wearer is walking or otherwise moving, so that such movement does not bounce the infant's head back and forth in an uncomfortable manner for the infant.

Each carrier end section 18 includes two sides comprising a joinable side **18*a* and a second side 18*b*, as designated in FIG. 2. The straps 14 and 16 are configured to extend around the wearer 12 with the carrier end sections 18 being positioned together along their joinable sides 18***a* and extending away from each other to their respective second sides 18*b*. A suitable joining means (such as buttons 28 and corresponding button holes) is disposed at the joinable sides 18*a* for joining said joinable sides together such that the carrier end sections 18 cooperatively form a carrying flap 30 having a lower end 32 and an upper end 33. The carrying flap 30 is configured and dimensioned to substantially cover the torso of the infant 24.

Any suitable attachment means in lieu of the tying ring 22 can be disposed at the carrying flap 30 for attaching the attachment end sections 20 to the lower end 32 of the flap when the retaining straps 14 and 16 extend around the wearer 12, such that the attachment end sections form a sitting portion 34 (FIG. 1) with the lower end of the flap, such that the infant 24 residing between the flap and the wearer is enabled to sit in suspension upon the sitting portion 34 with the infant's legs straddling the sitting portion as in FIG. 1.

It is preferable that the carrier end sections 18 be configured and positioned such that at least a majority of the carrier end sections do not overlap one another, and such that the retaining straps 14 and 16 are configured and dimensioned to (i) extend upwardly from the carrier end sections 18 toward and around opposing shoulders of the wearer 12, respectively, (ii) extend downwardly from the shoulders along the wearer's back toward and around opposing sides of the wearer, respectively, and (iii) terminate respectively in the attachment end sections 20 such that the carrier end sections 18 are reachable with the attachment end sections 20, as shown collectively in FIGS. 1–2.

As shown in FIGS. 1–2, the retaining straps 14 and 16 operate as a retaining means which is configured and arranged to retain the infant 24 between the carrying flap 30 and the wearer 12 without fully circumscribing the wearer's waist, by extending in the manner described above in items (i)–(iii).

It is further preferred that the retaining straps 14 and 16 be further configured, pursuant to (ii) above, to extend downwardly from the shoulders along the back and around the sides, without crossing over each other, with the carrier 10 further including suitable coupling means such as buckle 38 (FIG. 2) disposed on the retaining straps for coupling together opposing portions of said straps extending along the back of the wearer 12. The straps 14 and 16 may overlap somewhat as they pass through the buckle 38, but they preferably do not cross over each other in a criss-cross pattern. If desired, however, the wearer could remove the buckle 38 and cross the straps 14 and 16 in the back in a criss-cross pattern before tying the end sections 20 at the tying ring 22.

In addition to the novel disclosure set forth above, the invention can be described in other novel ways directed to the carrying flap 30 being configured and dimensioned to substantially cover a torso of the infant 24. The invention can be said to comprise the flap 30 and any suitable retaining means attached to the flap, such as the straps 14 and 16, for retaining the flap upon the wearer 12 and retaining the infant 24 between the flap and the wearer, wherein the retaining means is joined with the lower portion 32 of the flap to form the sitting portion 34 with the flap which is configured and dimensioned to enable the infant 24 to sit in suspension upon the sitting portion with said infant's legs straddling the sitting portion, and wherein the carrier 10 is characterized by an absence of any portion thereof residing between the infant 24 and the wearer 12 when the infant is retained between the flap and the wearer by the retaining means.

The carrier 10 may also be described in novel terms of the retaining straps 14 and 16 each having a width, a first end represented at phantom lines 19, and an opposing second end 20, respectively, even though the straps 14 and 16 are preferably integrally connected at 15. The collective widths of the straps 14 and 16 at their first ends 19 are equal to a majority length of the upper side 33 of the carrying flap 30, the straps 14 and 16 being connected at their first ends 19 to said upper side of the carrying flap such that said first ends are connected along and co-extensive with a majority length of the upper side 33, the retaining straps 14 and 16 being configured and dimensioned to (i) extend upwardly from the carrier end sections toward and around opposing shoulders of the wearer, respectively, (ii) extend downwardly from the shoulders toward and around opposing sides of the wearer, respectively, and (iii) terminate respectively in the second ends such that the lower side of the flap is reachable with said second ends, and wherein the carrier further includes any suitable attachment means such as the tying ring 22. As seen in FIG. 2, the collective widths of the straps 14 and 16 at their first ends 19 are preferably equal to the entire length of the upper side 33 of the carrying flap 30, and not just to the majority of the length.

Figure 3A:
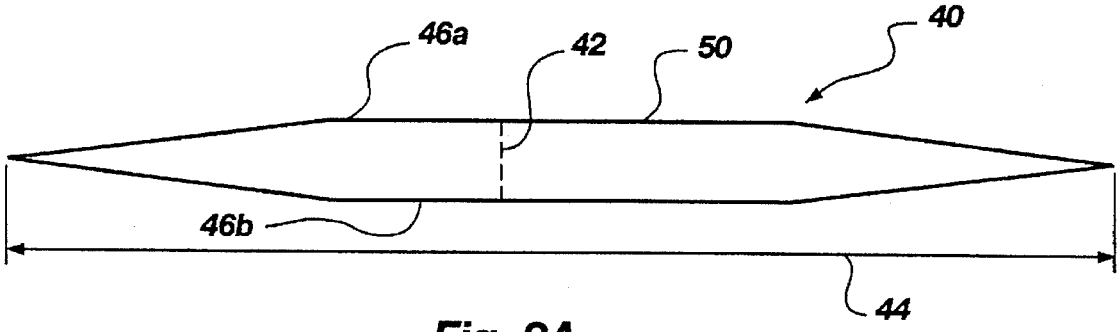
FIG. 3A is a plan view of a single strip of continuous material from which the wearable infant carrier of FIGS. 1–2 is made.

Referring now to FIGS. 1–3, the carrier 10 may further be described in novel terms of the carrying flap 30 and the retaining means (such as the straps 14 and 16) collectively comprising a one-piece unitary strip of material 40. The single strip of material 40 is a key element of a preferred method of manufacturing an infant carrier configured to be worn by a wearer, in accordance with the principles of the present invention, which includes the steps of:

(a) selecting a single, continuous elongate strip of material 40 having a width 42 and a principal length 44;

(b) folding the strip of material 40 along its principal length 44 so as to bring opposing edges 46*a* and 46*b* together such that the material has a folded side;

(c) fastening most of the opposing edges 46*a–b* together to form a hollow tube of material 48 (FIGS. 1–2) having tube walls, such that an entrance (preferably at middle portion 50) into the hollow tube 48 is formed by the portions of the opposing edges 46*a–b* which were not fastened together;

(d) drawing the tube of material 48 inside-out through the entrance to provide the tube with an inwardly-extending seam 51 along the opposing edges;

(e) folding the tube 48 of material across a central portion of its width 42 (preferably folding at 50) such that the tube includes opposing central sections 18 and opposing end sections 20, said opposing central sections 18 each having a joinable edge 18*a;*

(f) adding joining means 28 to the opposing central sections 18 for joining said central sections along their joinable edges 18*a* such that said central sections cooperatively form a carrying flap 30; and (g) adding attachment means 22 to the carrying flap 30 for attaching the opposing end sections 20 to the carrying flap.

Figure 3B:
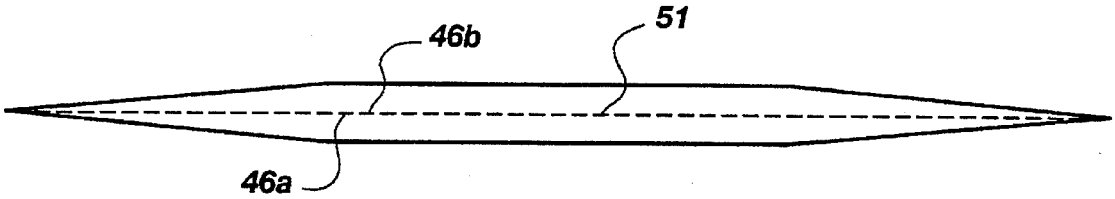
FIG. 3B is a plan view of the strip of material in FIG. 3A which has been manipulated and sewn in accordance with the principles of the present invention.

As shown in FIG. 3B, it is preferable to augment the above method with the following step:

(h) sliding the tube walls relative to each other and flattening the tube to bring the seam 51 to a middle position on one side.

The tying ring 22 can be made in any suitable manner, preferably by attaching a strip of cloth at one end to the carrying flap 30, drawing the strip around most of the lower flap end 32, and attaching the other end of the strip to the flap.

In use, the wearer 12 simply pulls the carrier 10 over their head as if they are putting on a tank-top or T-shirt. The wearer then draws the ends 20 around opposing sides of the waist, inserts them through opposing sides of the ring 22 and ties them together in a secure knot. The infant 24 is then placed between the straps 14 and 16 and the wearer's torso. The straps are joined together with the joining means (preferably buttons 28 and corresponding button holes) along their joinable ends 18*a* to form the carrying flap 30 which is configured and dimensioned to cover most or all of the infant's torso.

The headband 26 is optional, and may be placed behind or in front of the infant's head. It will be appreciated that the carrier 10 is adjustable to accommodate many different body sizes with respect to both the wearer and the infant. The ends 20 can be made long enough to enable the carrier 10 to be worn comfortably and securely by many different people. The carrier 10 does not encircle the neck of the wearer 12 in a restraining or uncomfortable manner. The carrier 10 is thus inherently adjustable and preferably utilizes only the single strip 40 of continuous material, with the option of the headband 26 and the buckle 38.

Those skilled in the art will appreciate that the scope of the present invention encompasses many combinations and a broad spectrum of features and structures equivalent to those specifically discussed herein. For example, although the preferred embodiment of the carrier 10 is manufactured from the single strip of continuous material 40, it may also be manufactured from multiple pieces of material sewn together. The infant 24 may face outwardly as shown in FIG. 1, or inwardly toward the wearer 12 if desired. Although it is preferred that the carrying flap 30 be positioned in front of the wearer's torso, the carrier 10 could also be worn backwards with the carrying flap 30 facing the wearer's back. Optional stitching 53 can be used to hold the material together above the tying ring 22.

Many of the advantages of the present invention result from the simplicity in use and manufacture of the carrier 10. Significant reductions in labor and material costs have been realized when the carrier 10 is manufactured from the single strip of material 40, in a manner consistent with the method set forth above. The prior art wearable infant carriers utilize a self contained pouch which the inventor finds redundant, in view of the improved carrier 10 which is very effective in securing the infant 24 against the wearer 12 without any such pouch or any part of the carrier 10 residing between the infant 24 and the wearer 12. It is also significant that the retaining straps 14 and 16 serve the additional function of forming the carrying flap 30 by joining together along their joinable edges 18*a*. Other advantages and equivalents of the preferred carrier 10 will occur to those having ordinary skill in the art.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. An infant carrier configured to be worn by a wearer, said infant carrier comprising:

first and second retaining straps, each strap including a carrier end section and an opposing attachment end section, wherein each carrier end section has two sides comprising a joinable side and a second side, said straps being configured to extend around the wearer with the carrier end sections being positioned together along their joinable sides and extending away from each other to their respective second sides;

joining means disposed at the joinable sides of the carrier end sections for joining said joinable sides together such that said carrier end sections cooperatively form a carrying flap having a lower end, said carrying flap being configured and dimensioned to substantially cover a torso of an infant; and attachment means disposed at the carrying flap for attaching the attachment end sections of the straps to the lower end of said carrying flap when the retaining straps extend around the wearer such that said attachment end sections form a sitting portion with said lower end of the flap, such that an infant residing between the carrying flap and the wearer is enabled to sit in suspension upon said sitting portion with said infant's legs straddling said sitting portion.

2. The infant carrier as defined in claim 1 and being configured to be worn by a wearer having a torso, back, shoulders and sides with the carrying flap positioned in front of a portion of the wearer's torso, wherein the carrier end sections are configured and positioned such that at least a majority of said carrier end sections do not overlap one another, and wherein the retaining straps are configured and dimensioned to (i) extend upwardly from the carrier end sections toward and around opposing shoulders of the wearer, respectively, (ii) extend downwardly from the shoulders along the back toward and around opposing sides of the wearer, respectively, and (iii) terminate respectively in the attachment end sections such that the carrier end sections are reachable with the attachment end sections.

3. The infant carrier as defined in claim 2, wherein the retaining straps are further configured, pursuant to (ii), to extend downwardly from the shoulders along the back and around the sides, without crossing over each other, said infant carrier further comprising:

coupling means disposed on the retaining straps for coupling together opposing portions of said straps extending along the back of the wearer.

4. The infant carrier as defined in claim 1, wherein the attachment means comprises a tying ring disposed on the lower end of the carrying flap and wherein both attachment end sections of the first and second retaining straps are configured and dimensioned to be tied to the tying ring.

5. The infant carrier as defined in claim 1, further comprising holding means disposed on the retaining straps for inhibiting movement of the infant's head relative to said retaining straps.

6. The infant carrier as defined in claim 1, wherein the joining means comprises at least one button and at least one button-hole respectively formed on the joinable sides of the carrier end sections.

7. An infant carrier configured to be worn by a wearer, said infant carrier comprising:

a carrying flap having upper and lower portions and being configured and dimensioned to substantially cover a torso of an infant; and retaining means attached to the flap for retaining said flap upon the wearer and retaining the infant between the flap and the wearer, wherein said retaining means is joined with the lower portion of the flap such that said retaining means intersects with the flap to form a sitting portion with said flap which is configured and dimensioned to enable the infant to sit in suspension upon the intersecting retaining means and flap forming said sitting portion with said infant's legs straddling said sitting portion;

wherein no portion of the infant carrier other than a part of the retaining means resides between the infant and the wearer when the infant is retained between the flap and the wearer by the retaining means.

8. The infant carrier as defined in claim 7 for use by a wearer having a waist, wherein the retaining means is configured and arranged to perform its retaining function without fully circumscribing the wearer's waist.

9. The infant carrier as defined in claim 7 and being configured to be worn by a wearer having a torso, back, shoulders and sides with the carrying flap positioned in front of a portion of the wearer's torso, wherein the retaining means comprises first and second straps configured and dimensioned to (i) extend upwardly from the carrying flap toward and around opposing shoulders of the wearer, respectively, (ii) extend downwardly from the shoulders along the back toward and around opposing sides of the wearer, respectively, and (iii) terminate respectively in attachment end sections such that the carrying flap is reachable with the attachment end sections.

10. The infant carrier as defined in claim 9, wherein the retaining straps are further configured, pursuant to (ii), to extend downwardly from the shoulders along the back and around the sides, without crossing over each other, said infant carrier further comprising:

coupling means disposed on the retaining straps for coupling together opposing portions of the retaining straps extending along the back of the wearer.

11. The infant carrier as defined in claim 7, wherein the attachment means comprises a tying ring disposed on the lower end of the carrying flap and wherein both attachment end sections of the first and second retaining straps are configured and dimensioned to be tied to the tying ring.

12. An infant carrier configured to be worn by a wearer, said infant carrier comprising:

a carrying flap having upper and lower portions and being configured and dimensioned to substantially cover a torso of an infant; and retaining means attached to the flap for retaining said flap upon the wearer and retaining the infant between the flap and the wearer, wherein said retaining means is joined with the lower portion of the flap such that said retaining means intersects with the flap to form a sitting portion with said flap which is configured and dimensioned to enable the infant to sit in suspension upon the intersecting retaining means and flap forming said sitting portion with said infant's legs straddling said sitting portion;

wherein the carrying flap and the complete retaining means collectively comprise a one-piece unitary strip of material.

13. The infant carrier as defined in claim 12 for use by a wearer having a waist, wherein the retaining means is configured and arranged to perform its retaining function without fully circumscribing the wearer's waist.

14. The infant carrier as defined in claim 12 and being configured to be worn by a wearer having a torso, back, shoulders and sides with the carrying flap positioned in front of a portion of the wearer's torso, wherein the retaining means comprises first and second straps configured and dimensioned to (i) extend upwardly from the carrying flap toward and around opposing shoulders of the wearer, respectively, (ii) extend downwardly from the shoulders along the back toward and around opposing sides of the wearer, respectively, and (iii) terminate respectively in attachment end sections such that the carrying flap is reachable with the attachment end sections.

15. The infant carrier as defined in claim 14, wherein the retaining straps are further configured, pursuant to (ii), to extend downwardly from the shoulders along the back and around the sides, without crossing over each other, said infant carrier further comprising:

coupling means disposed on the retaining straps for coupling together opposing portions of the retaining straps extending along the back of the wearer.

16. The infant carrier as defined in claim 12, wherein the attachment means comprises a tying ring disposed on the lower end of the carrying flap and wherein both attachment end sections of the first and second retaining straps are configured and dimensioned to be tied to the tying ring.

17. An infant carrier configured to be worn by a wearer, said infant carrier comprising:

a carrying flap configured and dimensioned to cover a majority of an infant's torso, said flap having upper and lower sides;

right and left retaining straps each having a width and first and second opposing ends, said straps being connected at their first ends to said upper side of the carrying flap, said retaining straps being configured and dimensioned to (i) extend upwardly from the carrier end sections toward and around opposing shoulders of the wearer, respectively, (ii) extend downwardly from the shoulders toward and around opposing sides of the wearer, respectively, and (iii) terminate respectively in the second ends such that the lower side of the flap is reachable with said second ends; and attachment means disposed at the carrying flap for attaching the second ends of the straps to the lower side of the flap when the retaining straps are positioned around the shoulders and waist of the wearer such that said retaining straps intersect with the flap to form a sitting portion with said flap such that an infant residing between the carrying flap and the wearer is enabled to sit in suspension upon the intersecting retaining straps and flap forming said sitting portion with said infant's legs straddling said sitting portion.

18. The infant carrier as defined in claim 17, wherein the collective widths of the straps at their first ends are equal to a majority length of the upper side of the carrying flap, and wherein the straps are connected such that said first ends are connected along and co-extensive with a majority length of said upper side of the carrying flap.

19. The infant carrier as defined in claim 17 and being configured to be worn by a wearer having a torso, back, shoulders and sides with the carrying flap positioned in front of a portion of the wearer's torso, wherein the retaining means comprises first and second straps configured and dimensioned to (i) extend upwardly from the carrying flap toward and around opposing shoulders of the wearer, respectively, (ii) extend downwardly from the shoulders along the back toward and around opposing sides of the wearer, respectively, and (iii) terminate respectively in attachment end sections such that the carrying flap is reachable with the attachment end sections.

20. The infant carrier as defined in claim 19, wherein the retaining straps are further configured, pursuant to (ii), to extend downwardly from the shoulders along the back and around the sides, without crossing over each other, said infant carrier further comprising:

coupling means disposed on the retaining straps for coupling together opposing portions of the retaining straps extending along the back of the wearer.

21. The infant carrier as defined in claim 17, wherein the attachment means comprises a tying ring disposed on the lower end of the carrying flap and wherein both attachment end sections of the first and second retaining straps are configured and dimensioned to be tied to the tying ring.

22. A method for manufacturing an infant carrier configured to be worn by a wearer, said method comprising the steps of:

(a) selecting a single, continuous elongate strip of material having a width and a principal length;

(b) folding the strip of material along its principal length such that the material has a folded side and opposing sides;

(c) fastening most of the opposing sides together to form a hollow tube of material having tube walls, such that an entrance into the hollow tube is formed by opposing sides which were not fastened together;

(d) drawing the tube of material inside-out through the entrance to provide the tube with an inwardly-extending seam along one side, which seam is then placed in the middle along the opposing sides;

(e) folding the tube of material across a central portion of its width such that the tube includes opposing central sections and opposing end sections, said opposing central sections each having a joinable edge;

(f) adding joining means to the opposing central sections for joining said central sections along their joinable sides such that said central sections cooperatively form a carrying flap; and (g) adding attachment means to the carrying flap for attaching the opposing end sections to the carrying flap.

23. The method for manufacturing an infant carrier as defined in claim 22, further comprising the step of:

(h) sliding the tube walls relative to each other and flattening the tube to bring the seam to a middle position on one side.

* * * * *